United States Patent [19]

Narain et al.

[11] Patent Number: 4,775,387

[45] Date of Patent: Oct. 4, 1988

[54] SULFUR REMOVAL AND COMMINUTION OF CARBONACEOUS MATERIAL

[75] Inventors: Nand K. Narain, Bethel Park; John A. Ruether, McMurray; Dennis N. Smith, Herminie, all of Pa.

[73] Assignee: The United States of America as represented by the United States Department of Energy, Washington, D.C.

[21] Appl. No.: 105,166

[22] Filed: Oct. 7, 1987

[51] Int. Cl.[4] ..... C10L 10/00

[52] U.S. Cl. ..... 44/624; 44/51

[58] Field of Search ..... 44/1 SR, 51

[56] References Cited

U.S. PATENT DOCUMENTS

| | | | |
|---|---|---|---|
| 3,993,455 | 11/1976 | Reggel et al. | 44/1 R |
| 4,313,737 | 2/1982 | Massey et al. | 44/1 SR |
| 4,421,722 | 12/1983 | Massey et al. | 422/129 |
| 4,497,636 | 2/1985 | Aida et al. | 44/15 R |

OTHER PUBLICATIONS

Utz; "Molten Hydroxide Coal Desulfurization Using Model Systems"; ACS Symposium Series No. 319; Fossil Fuels Utilization: Environmental Concerns.

Gravimelt Process Development, Final Report, TRW Energy Development Group, U.S. DOE Contract No. DE-AC22-81PC42295, pp. 1-8 (1983).

Boron, "Prospects for Chemical Coal Cleaning," 1983 Society of Mining Engineers Fall Meeting.

Narain, "Explosive Comminution," Quarterly Report-Apr.-Jun. 1986, Pittsburgh Energy Technology Center.

Mathur et al., "Explosive Comminution of Coal, " Proceeding of the Direct Utilization AR & TD Meeting Sep. 22, 1987.

*Primary Examiner*—Wayland Stallard

*Attorney, Agent, or Firm*—Hugh W. Glenn; Paul A. Gottlieb; Judson R. Hightower

[57] ABSTRACT

Finely divided, clean coal or other carbonaceous material is provided by forming a slurry of coarse coal in aqueous alkali solution and heating the slurry under pressure to above the critical conditions of steam. The supercritical fluid penetrates and is trapped in the porosity of the coal as it swells in a thermoplastic condition at elevated temperature. By a sudden, explosive release of pressure the coal is fractured into finely divided particles with release of sulfur-containing gases and minerals. The finely divided coal is recovered from the minerals for use as a clean coal product.

16 Claims, 2 Drawing Sheets

SULFUR REMOVAL AND COMMINUTION OF CARBONACEOUS MATERIAL

CONTRACTUAL ORIGIN OF THE INVENTION

The United States Government has rights in this inventin pursuant to the employer-employee relationship of the Government to the inventors as U.S. Department of Energy employees.

BACKGROUND OF THE INVENTION

The invention relates to methods for producing clean coal of reduced sulfur content and more particularly to a method for the explosive comminution of coal.

Coal remains a major energy resource but much of the coal cannot be used economically because of its high sulfur content. The sulfur in coal combustion products may be a major contributor to acid rain.

Sulfur is contained in coal in organic or inorganic form. The organic sulfur is chemically bonded into the coal matrix while the inorganic sulfur occurs mainly as pyrite ($FeS_2$) mixed with other inorganic minerals. During combustion, most of the sulfur is released as sulfur dioxide ($SO_2$) which forms sulfuric acid from reaction with atmospheric moisture.

There are various approaches for limiting the discharge of sulfuric acid from coal combustion processes. The sulfur can be removed from the coal prior to combustion. It can be removed during the combustion stage or from the effluent gases. The present invention addresses this problem by removing sulfur and other mineral matter prior to use of coal.

Representative prior processes in pre-treatment of coal include those that employ explosive comminution as described in U.S. Pat. Nos. 4,313,737 and 4,421,722, both to Massey et al. A process of this type generally is most effective in the removal of pyritic sulfur and other minerals from comminuted coal. Consequently, these processes are limited in the fraction of sulfur that can be removed.

In other efforts, coal has been treated with molten alkaline in an effort to remove both the organic and inorganic sulfur. Although high proportions of this sulfur can be removed by this method, large quantities of molten alkaline, up to 10 times the weight of the coal in prosess, are required.

Therefore, in view of the above discussion, it is an object of the present invention to provide an improved process for removing objectionable materials from coal.

It is a further objective to provide a clean coal process in which a high proportion of sulfur is removed.

It is also an object of this invention to provide a process for removing sulfur from coal and other carbonaceous material wherein the material is comminuted to a finely divided powder.

SUMMARY OF THE INVENTION

In accordance with the present invention, a method is provided for removing sulfur from carbonaceous material in conjunction with the comminution of the material. The method involves forming a slurry of the carbonaceous material and aqueous alkali-containing solution. The temperature and pressure of the slurry are increased to at least the critical temperature and pressure of steam. On abruptly releasing the pressure, the carbonaceous material is explosively comminuted to fine particles, and sulfur containing gases are released.

The alkali is then separated from the comminuted carbonaceous material.

In other aspects of the invention, the temperature and pressure are raised to about 375° to 500° C., preferably about 400° C., and to 220 to 400 atmospheres, preferably about 250–300 atmospheres prior to the abrupt release in pressure. In other aspects, the pressure is abruptly reduced by a factor of more than 40, preferably about 40 to 60 in a short time interval of less than 1/100 of a second and preferably less than 1 millisecond.

In yet other aspects of the invention, steam and sulfur containing gases as withdrawn from contact with the carbonaceous material following the explosive comminution. With further cooling the carbonaceous material is washed with aqueous solution to recover and recycle alkali. In addition, the carbonaceous material is classified into an oversized fraction for recycle in the process and an undersized fraction for physical removal of minerals and recovery as carbonaceous product. The undersized fraction is preferably less than about 10 to 30 microns particle size.

In other aspects of the invention, the carbonaceous material for the slurry is selected from coal particles of no more than 2.5 cm and blended with about 0.5 to 3 parts by weight water and 0.05 to 0.2 parts by weight alkali to one part by weight coal. The alkali is selected from the hydroxides of sodium and potassium. Preferably, potassium hydroxide is selected as the alkali used in the slurry.

In other aspects of the invention, a method is provided for producing a finely divided, clean coal by first slurrying a coarse coal with solution containing the hydroxides of sodium or potassium. The slurry is heated and pressurized to above the critical conditions of steam whereby supercritical phase is formed in contact with the coal particles. On explosively releasing the pressure in the supercritical phase, the coal is comminuted into finely divided form with release of sulfur containing gases and inorganic material. The finely divided coal is recovered as product from the inorganic material and alkali.

BRIEF DESCRIPTION OF THE DRAWINGS

The present invention is illustrated in the accompanying drawings wherein.

DETAILED DESCRIPTION OF THE PREFERRED EMBODIMENT

Figure 1:
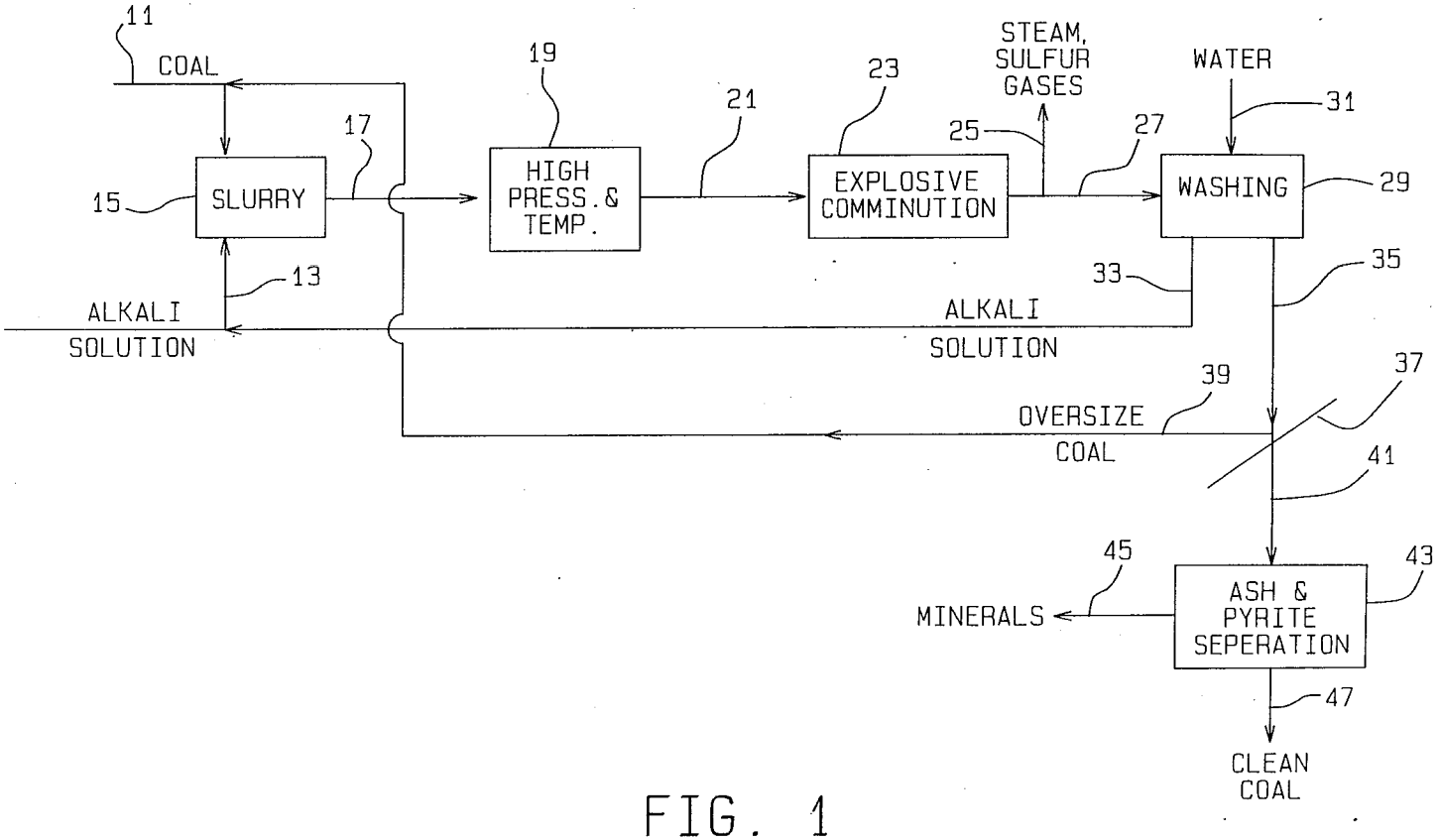
FIG. 1 is a diagrammatic representation of a process for producing clean, carbonaceous material.

One manner of carrying out the present invention is illustrated in the flow diagram of FIG. 1. Coal or other carbonaceous material 11 is blended with an alkali solution 13 in a suitable vessel or container 15 to form a slurry 17. The slurry is confined in a pressure vessel 19 and brought to above the critical conditions of steam. Subsequently, the pressure is released at 21 through a nozzle or rupture disc resulting in explosive fracturing or comminution of the carbonaceous material at 23. As a result of this abrupt release of pressure in a very short time interval, steam and sulfur gases can be discharged at 25 and the remaining coal and minerals 27 washed with water 31 in a suitable operation illustrated at 29 to form a recovered alkali solution 33 for recycle into the original slurry at 15 and a solid mixture of carbonaceous and mineral material 35. Solids are separated as in a screening operation at 37 into an oversized fraction 39 that can be recycled to the slurry and an undersized fraction 41, that is advantageously further processed at 43 to separate pyrite and other minerals 45 from the finely divided clean coal 47.

In forming the slurry of carbonaceous material and alkali solution, a substantially smaller amount of alkali is employed than in previous processes which rely on the action of molten alkali on the carbonaceous material for sulfur removal. In the present invention, an effective slurry will include about 0.05 to 0.2 parts by weight alkali to one part by weight of carbonaceous material. Although all of the alkali metal hydroxides are contemplated for use in the present invention, sodium hydroxide or potassium hydroxide are selected based on availability and economic considerations. As will be seen below, the inventors have found potassium hydroxide to be particularly advantageous and preferred for use in obtaining a high level of sulfur removal.

Sufficient water is included in the slurry to solubilize the selected alkali and enhance contact with the carbonaceous material in the slurry. Potassium hydroxide, sodium hydroxide and cesium hydroxide are all very soluble in water, such that 1 to 3 weight parts water per part of coal can be conveniently used in the the slurry composition.

In order to take full advantage of the explosive comminution of the coal or other carbonaceous material, excessive physical grinding and fracturing of the raw material is to be avoided. Some pregrinding may be conveniently to facilitate handling, for instance to provide slurry particles sizes of no more than 2.5 cm. Smaller particle sizes may be selected in proccesses involving explosive pressure release through a nozzle. Advantageously, explosive size reduction to about 10 to 30 microns particle size provides enhanced sulfur and minerals separation from coal.

Figure 2:
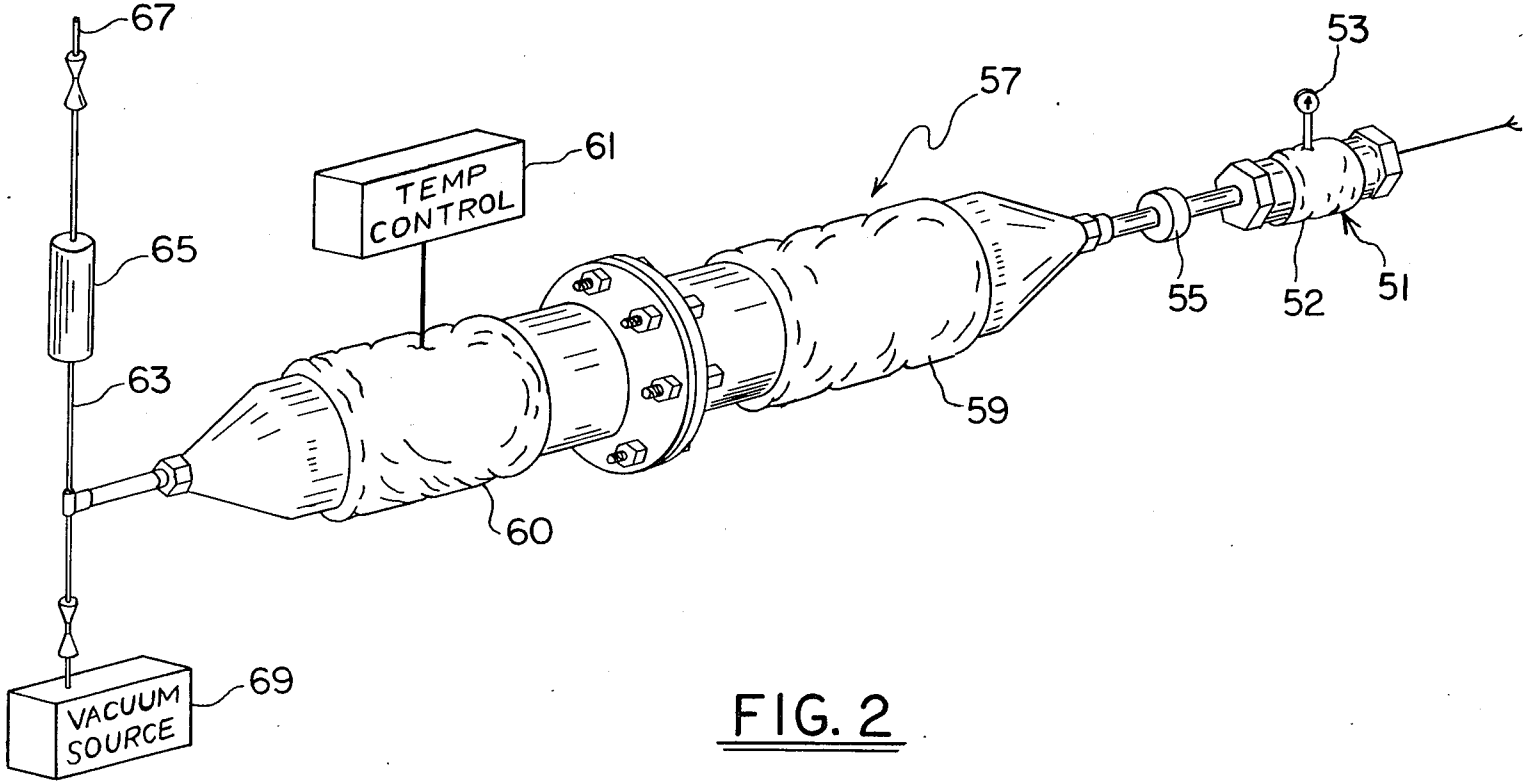
FIG. 2 is a prospective illustration of a device for performing the explosive comminution of carbonaceous material.

A chamber for carrying out an explosive comminution is illustrated in FIG. 2. A relatively small chamber 51 equipped with suitable temperature and pressure measuring devices 53 was adapted to receive slurry of aqueous solution and carbonaceous material. The slurry pressure is increased such as by pumping and heating to above the critical point of steam. For example, pressures of 220 to 400 atmospheres are contemplated in the present process. A suitable heater illustrated as an electrical resistance unit 52 surrounds chamber 51 for elevating the temperature to above the critical temperature of the steam. It is contemplated that temperatures of 375° to 500° C. and preferably of about 400° C. will be used in preparation of the explosive comminution.

After a suitable supercritical temperature and pressure are achieved, for instance, 400° C. and 250–300 atmospheres a device 55 for abruptly releasing the pressure is activated to rapidly expand the supercritical fluid into the layer receiver 57. Device 55 can be a suitable rupture disc installed in the line and designed to rupture at the selected temperature and pressure. Other devices such as rapidly activating valves and quick-opening nozzles may also be employed.

Receiver 57 also is provided with suitable heaters 59 and 60 with temperature measuring and controlling means 61 for regulating temperature. Although the heaters 52, 59 and 60 are illustrated such as Kanthol electric heaters, it will be clear that in larger industrial applications other types of heaters, for instance those employing fossil fuels, may be used.

Receiver 57 is selected to be on the order of 40 to 60 times the volume of chamber 51 to result in a corresponding pressure reduction in an extremely small time interval. Rupture disc 55 or its equivalent is designed to rapidly release the pressure from chamber 51 into receiver 57 to perform the desired comminution of a carbonaceous material. Pressure reduction by at least a factor of 40 in less than 1/100 of a second is of importance. Preferably pressure reductions of 40 to 60 times in less than a millisecond are contemplated in carrying out the process of this invention. It is necessary that the rapid pressure reduction occurs such that gases trapped within the heated carbonaceous material under plastic conditions will abruptly and violently fracture the coal or other carbonaceous material as such entrapped gases rapidly expand.

Gases expanded into receiver 57 can be discharged through line 63, sample container 65 and released from the process at 67. In order to enhance the effectiveness of receiver 57, a vacuum source 69 can be provided to evacuate ambient gases from receiver 57 prior to the explosive comminution step.

Following the explosive comminution, the carbonaceous material, mineral matter and alkali remaining in vessels 51 and 57 can be washed out for further processing.

It is of considerable advantage that coal be heated to a temperature at which swelling in a thermoplastic state begins prior to the explosive comminution step. Bituminous coal enters the thermoplastic state at about 375°–400° C. Preferably a temperature of about 400° C. is selected for use. In the thermoplastic state, the porosity of the organic coal material begins to collapse, trapping pockets of supercritical fluid such that on rapid expansion the trapped gases effectively comminute the coal to a finely divided material. Such comminution also releases mineral and pyritic sulfur to afford its separation from the carbonaceous material.

The following example is submitted only for purposes of illustration and is not to limit the scope of the invention as defined in the claims. The example also contrasts the sulfur reduction obtained by comminution with steam to the sulfur reduction obtained by comminution with an aqueous solution of potassium hydroxide.

EXAMPLE

A small sample of Illinois No. 6 coal with about 3.6% sulfur by weight and of about 250 microns maximum particle size was pressurized to about 350–370 atmospheres at about 407° to 412° C. in an apparatus similar to that illustrated in FIG. 2. On abrupt release of the pressure through the rupture disc, the comminuted coal is recovered and classified into two fractions of above and below 25 microns particle size. Table 1 below gives the results showing comminution only with water turned to steam and Table 2 shows a substantial improvement in sulfur reduction obtained by comminution with a aqueous solution of potassium hydroxide.

TABLE 1

COMMINUTION WITH WATER

| | $DT_{4-2}$ | $DT_{4-10}$ |
|---|---|---|
| Reaction Conditions | | |
| Pressure, atmosphere | 360 | 370 |
| Temperature, °C. | 409 | 408 |
| Reactor volume, ml | 16 | 70 |
| Charge | | |
| Weight of Coal, g | 3 | 10 |

TABLE 1-continued

| COMMINUTION WITH WATER | $DT_{4-2}$ | $DT_{4-10}$ |
|---|---|---|
| Weight of Water, g | 7 | 30 |
| Material Balance on Coal % | 70 | 82 |
| Product Analysis | | |
| A. Total Sulfur | 3.4 | 3.2 |
| %, Total sulfur removal (Solid Analysis) | 7.4 | 11 |
| B. Particle size above 25 um, wt % | 28 | 9 |
| Particle size below 25 um, wt % | 72 | 91 |
| Mean volume particle size, um of fraction less than 25 um | 3.8 | 9.3 |

TABLE 2

| COMMINUTION WITH WATER + KOH | | |
|---|---|---|
| Reaction Conditions | | |
| Pressure, Atmospheres | 350 | 354 |
| Temperature, °C. | 408 | 412 |
| Reactor Volume, ml | 70 | 70 |
| Charge | | |
| Weight of Coal, g | 10 | 10 |
| Wt. of Water, g | 30 | 30 |
| Wt. of KOH, g | 0.5 | 1 |
| Material Balance of Coal % | 89 | 88 |
| Feed and Product Analysis | | |
| A. Total Sulfur, wt % | 3.2 | 2.9 |
| % Total sulfur removal (solid analysis) | 13.5 | 20.3 |
| B. Particles above 25 um, wt % | 25 | 17 |
| Particles below 25 um, wt % | 75 | 83 |
| Mean volume particle sizes, um, of fraction less than 25 um | 3.8 | 8.6 |

It is clearly seen that a substantial and unexpected increase in sulfur reduction is obtained through use of the aqueous solution of potassium hydroxide for the comminution of the coal.

The inventors have also found that greater improvements in sulfur reduction occur with the use of potassium hydroxide over sodium hydroxide. In other operations involving Illinois No. 6 coal having about 3.7% sulfur, and of about 180 microns maximum particle size, nearly 40% sulfur removal was obtained employing aqueous solution of potassium hydroxide compared to a little less than 25% using a comparable solution of sodium hydroxide. Tables 3 and 4 given below illustrate the advantageous use of potassium hydroxide in aqueous solution before bringing about a explosive comminution of bituminous coal.

TABLE 3

EXPLOSIVE COMMINUTION OF BITUMINOUS COAL USING WATER AND KOH

| Coal (gm) | Water (gm) | KOH (gm) | T (°C.) | P (Atm) | Wt % < 25 um (Sieving) | Total S Red., % (maf) |
|---|---|---|---|---|---|---|
| 16 | 16 | — | 382 | 250 | 84.3 | 7.4 |
| 16 | 16 | 0.48 | 377 | 260 | 85.0 | 5.7 |
| 16 | 16 | 0.80 | 362 | 260 | 77.4 | 25.9 |
| 16 | 16 | 1.6 | 379 | 255 | 79.5 | 31.3 |
| 16 | 16 | 2.4 | 380 | 250 | 82.7 | 39.8 |
| 16 | 16 | 3.2 | 389 | 267 | 84.6 | 33.8 |

TABLE 4

EXPLOSIVE COMMINUTION OF BITUMINOUS COAL USING WATER AND NaOH

| Coal (gm) | Water (gm) | NaOH (gm) | T (°C.) | P (Atm) | Wt % < 25 um (Sieving) | Total S Red., % (maf) |
|---|---|---|---|---|---|---|
| 16 | 16 | 0.48 | 376 | 244 | 81.7 | 19.0 |
| 16 | 16 | 0.80 | 379 | 245 | 76.3 | 6.3 |
| 16 | 16 | 1.6 | 381 | 260 | 78.6 | 17.2 |
| 16 | 16 | 2.4 | 388 | 270 | 67.5 | 24.5 |
| 16 | 16 | 3.2 | 397 | 273 | 81.7 | 22.3 |

It is therefore seen that the present invention provides an improved process for both the commminution and removal of sulfur from coal. A finely divided clean coal can be produced by the process of the present invention. By selecting an aqueous solution of potassium hydroxide, sulfur reductions near to 40% can be obtained. The process permits the recovery of alkali for recycle following the comminution step.

Although the present invention has been described in terms of a specific embodiment, it will be clear that modifications or alterations may be made by one skilled in the art in the materials, process components and arrangements within the scope of the invention defined in the attached claims.

The embodiment of the invention in which an exclusive property or privilege is claimed is defined as follows:

1. A method of removing sulfur during the comminution of carbonaceous material comprising:

forming a slurry including said carbonaceous material in aqueous, alkali-containing solution, increasing the temperature and pressure of said slurry to at least the critical temperature and pressure of steam;

abruptly reducing said pressure to explosively comminute said carbonaceous material and release sulfur containing gases;

separating said alkali from said comminuted carbonaceous material.

2. The method of claim 1 wherein said temperature and pressure are increased to 375°–500° C. and 220 to 400 atmospheres respectively wherein said carbonaceous material enters a thermo-plastic state prior to the abrupt reduction in pressure.

3. The method of claim 2 wherein said temperature is increased to about 400° C. and said pressure to about 250–300 atmospheres.

4. The method of claim 1 wherein said pressure is abruptly reduced by a factor of more than 40 in less than one-one hundredth of a second.

5. The method of claim 4 wherein said pressure is abruptly reduced by a factor of 40–60 in less than one millisecond.

6. The method of claim 1 wherein said temperature and pressure are reduced to form superheated steam and such steam with sulfur containing gases are withdrawn from contact with said carbonaceous material and alkali.

7. The method of claim 6 wherein said temperature is further reduced and said carbonaceous material washed with aqueous solution to separate and recover said alkali from said carbonaceous material.

8. The method of claim 7 wherein said carbonaceous material is classified into at least two fractions by size with an oversize fraction recycled to said slurry for explosive comminution and an undersize fraction further processed to remove minerals and recovered as carbonaceous product.

9. The method of claim 8 wherein said undersize fraction is less than about 10 to 30 microns particle size and said oversize fraction is of larger particle size than said undersize fraction.

10. The method of claim 1 wherein said slurry includes coal, water and alkali with about 0.5 to 3 parts by weight water to coal and about 0.05 to 0.2 parts by weight alkali to coal.

11. The method of claim 1 wherein said alkali is selected from the group of hydroxides consisting of sodium hydroxide and potassium hydroxide.

12. The method of claim 1 wherein said alkali is potassium hydroxide.

13. The method of claim 1 wherein said alkali is dissolved in aqueous solution to form a slurry with solid carbonaceous material and is in liquid phase in contact with said carbonaceous material at elevated temperatures above the critical temperature of steam.

14. A method of producing a finely divided, clean coal comprising:

slurry a coarse coal with solution containing an alkali selected from the hydroxides of sodium and potassium;

heating and pressurizing said slurry to above the critical conditions of steam to form a supercritical phase in contact with said coal particles;

explosively releasing the pressure of said supercritical phase to comminute said coal into finely divided form and to release sulfur containing gases and inorganic minerals; and recovering said finely divided coal as product from a fraction containing said inorganic minerals.

15. The method of claim 14 wherein said coarse coal includes particle sizes greater than those of said finely divided coal and wherein said finely divided coal is less than about 30 microns particle size.

16. The method of claim 14 wherein an aqueous solution containing about 0.15 parts by weight potassium hydroxide to about 1 part water is slurried with about 1 part coal and heated to about 400° C. at a pressure of about 250–300 atmospheres.

* * * * *